US005898111A

United States Patent [19]

Blankenship et al.

[11] Patent Number: 5,898,111

[45] Date of Patent: Apr. 27, 1999

[54] METHOD AND APPARATUS FOR PERFORMING ISOINERTIAL BOX LIFTING

[75] Inventors: Keith L. Blankenship; Earl Van Wagoner, both of Macon, Ga.

[73] Assignee: The Blankenship Corporation, Macon, Ga.

[21] Appl. No.: 08/881,541

[22] Filed: Jun. 24, 1997

Related U.S. Application Data

[60] Provisional application No. 60/020,538, Jun. 25, 1996.

[51] Int. Cl.[6] ..... G01L 1/04

[52] U.S. Cl. ..... 73/379.01; 482/93

[58] Field of Search ..... 482/4, 6, 93, 97, 482/901, 903; 73/379.01; 702/41, 141, 174; 414/744.3

[56] References Cited

U.S. PATENT DOCUMENTS

| | | | |
|---|---|---|---|
| 4,566,692 | 1/1986 | Brentham | 272/130 |
| 4,702,108 | 10/1987 | Amundsen et al. | 73/379 |
| 4,774,679 | 9/1988 | Carlin | 364/550 |
| 4,882,677 | 11/1989 | Curran | 364/413.02 |
| 4,907,797 | 3/1990 | Gezari et al. | 272/129 |
| 4,912,638 | 3/1990 | Pratt, Jr. | 364/413.02 |
| 4,941,660 | 7/1990 | Winn et al. | 272/76 |
| 5,142,910 | 9/1992 | Litchman | 73/379 |
| 5,151,071 | 9/1992 | Jain et al. | 482/101 |
| 5,178,160 | 1/1993 | Gracovetsky | 128/782 |
| 5,249,967 | 10/1993 | O'Leary et al. | 434/247 |
| 5,275,045 | 1/1994 | Johnston et al. | 73/379.01 |
| 5,331,851 | 7/1994 | Parviainen et al. | 73/379.01 |
| 5,348,519 | 9/1994 | Prince et al. | 482/6 |
| 5,498,162 | 3/1996 | Schaefer | 434/258 |

OTHER PUBLICATIONS

Rowland G. Hazard, et al.; Dynamic Lifting Capacity: The Relationship Between Peak Force and Weight as an Indicator of Effort, Journal of Spinal Disorders, vol. 4 No. 1, pp. 63–67.

Rowland G. Hazard, M.D., et al., Lifting Capacity, Spine vol. 17, Apr. 13, 1992.

Product Material for the FCE System, Blankenship Corporation Date Unknown.

Product Material for the System Interface, Blankenship Corporation Date Unknown.

*Primary Examiner*—Ronald Biegel

*Attorney, Agent, or Firm*—Thomas, Kayden, Horstemeyer & Risley, L.L.P.

[57] ABSTRACT

A lift box and system simulates the lifting of a crate or box having cutout handles disposed therein. The lift box includes the normal hand hole cutouts, a structural frame adapted to hold a variable amount of disc-type weights and an outer shell which covers the frame and creates an inside cavity which contains the weights. A top surface of each hand hole cutout (the handle) is formed from a separate piece which is isolated from the shell and coupled to the frame through load cells. That arrangement prevents the user from applying any lifting force to the side walls of the lift box, which would reduce the overall force recognized by the load cells. To further the goal of force isolation from sides of the box, the handles include guards to convey all forces applied from the users hands directly to the load cells

26 Claims, 9 Drawing Sheets

FIG. 13

BLANKENSHIP, KEITH LEG LIFT PAGE 1 OF 2

| PRE TEST | | PP WEIGHT | KP WEIGHT | TBS MODEL | POST TEST | |
|---|---|---|---|---|---|---|
| PAIN | 1 | 100 | 100 | 110 | PAIN | 1 |
| H.R. | 78 | | | | H.R. | 109 |

| LIFT | 1 | 2 | 3 | 4 | 5 | 6 | 7 |
|---|---|---|---|---|---|---|---|
| WEIGHT | 10 | 30 | 50 | 70 | 90 | 110 | 130 |
| PAIN | 1 | 1 | 1 | 1 | 1 | 1 | 1 |
| H.R. (% MAX) | 101(60) | 104(62) | 100(59) | 109(64) | 109(64) | 110(65) | 116(69) |
| PEAK ACCEL-G'S | 1.60 | 1.60 | 1.63 | 1.49 | 1.42 | 1.33 | 1.25 |
| % CHANGE-G'S | N/A | -0.00% | -0.02% | -0.07% | -0.11% | -0.17% | -0.22% |
| PEAK FORCE LIFT | 16.0 | 48.0 | 81.4 | 104.6 | 128.2 | 146.2 | 163.0 |
| PEAK FORCE LOWER | 13.4 | 39.2 | 68.2 | 90.4 | 110.8 | 129.2 | 154.0 |
| (FORCE-WEIGHT) | 6.0 | 18.0 | 31.4 | 34.6 | 38.2 | 36.2 | 33.0 |
| LIFT FORCE VARIANCE | 10.0 | 35.6 | 50.8 | 63.4 | 76.0 | 75.4 | 64.2 |
| LOWER FORCE VARIANCE | 9.2 | 27.8 | 51.8 | 66.2 | 72.2 | 70.6 | 99.0 |
| % B.W. (WEIGHT) | 5% | 14% | 24% | 33% | 43% | 52% | 62% |
| % B.W. (FORCE) | 8% | 23% | 39% | 50% | 61% | 70% | 78% |

Esc EXIT F1 HELP

CALCULATED WEIGHT: 103.85

METHOD AND APPARATUS FOR PERFORMING ISOINERTIAL BOX LIFTING

RELATED APPLICATIONS

This application claims priority to provisional application Ser. No. 60/020,538,filed on Jun. 25, 1996, and is incorporated herein by reference in its entirety.

FIELD OF THE INVENTION

The present invention relates generally to devices which measure lifting force in a realistically simulated working environment. More specifically, the present invention relates to an improved isoinertial lifting box configuration and system for its use.

DESCRIPTION OF THE PRIOR ART

Various devices and methods have been developed for measuring isoinertial box lifting capability, most of these are in the form of a machine which restrict movement to only the vertical plane. Another device developed by University of Vermont researchers is in the form of a lifting box; however, the handle apparatus is such that the handles are extended beyond the normal frame of the box, which resembles lifting a "tray." In this regard, see R. W. Hazard et al., "Dynamic Lifting Capacity: The Relationship Between Peak Force And Weight As An Indicator Of Effect, *Journal of Spinal Disorders*, Vol. 4,No. 1,pp. 63–67 (1991) and R. W. Hazard el al., "Lifting Capacity," *Spine,* Vol. 17, No. 9, (1992), both of which are incorporated herein by reference.

Currently, there is no apparatus or method known to the inventor to allow an individual to perform an isoinertial lift with a box that represents the same type of box or natural lifting conditions that he or she would be otherwise exposed to in industry.

With the forgoing disadvantage of the prior art in mind, it is an object of the present invention to provide a lifting box and system which simulates the lifting of a crate or box having cut-out handles.

It is another object of the present invention to provide a lifting box and system which prevents a user from applying lifting forces to side walls of an isoinertial lifting box.

It is another object of the present invention to provide an isoinertial lifting box and system to convey all forces applied by user through the lifting box handles and to load cells coupled to the handles.

Other objects, features and advantages of the present invention will become apparent upon reading the following specification, when taken in conjunction with the accompanying drawings.

SUMMARY OF THE INVENTION

Generally speaking, the present invention relates to an isoinertial lifting device for measuring lifting forces transmitted through a container handle during a lifting motion. The lifting device includes a structural frame adapted to support a variable number of weights and an outer shell attached to the frame to define a cavity within the box. The outer shell includes first and second cutouts disposed on opposite sides of the frame for accepting handles, as is explained in greater detail below. The frame of the inventive lifting device also comprises a top member having the shape of a rectangular perimeter, and a bottom member having first and second ends attached to opposite sides of the top member, wherein the bottom member includes a guide pin adapted to accept disc-type weights. The guide pin prevents the weights from shifting during an isoinertial lift.

The lifting device also includes first and second load cells disposed on opposite sides of the frame near the first and second cutouts, respectively. The first and second cutouts receive handles for fastening to the frame, wherein the handles transmit all force from a lifter's hands to the first and second load cells, respectively. Of critical importance to the invention is that the handles are arranged and configured to transmit forces exclusively to the load cells, and to completely isolate the user's lifting forces from the shell of the lifting device.

In a presently preferred embodiment of the invention, a standard lift box includes the normal hand hole cutouts. The top surface of each hand hole cutout (the handle) is in the form of the normal cutout, but is formed from a separate piece which is isolated from the shell and coupled to the frame through the load cells. That arrangement prevents the user from applying any lifting force to the side walls of the lift box, which would reduce the overall force recognized by the load cells. To further the goal of force isolation from sides of the box, the handles include guards to convey all forces applied from the users hands directly to the load cells. Hence, the user's hands are isolated from the walls of the box.

As discussed above, the handles are substantially flush with an outside periphery of the shell to simulate cutout handles on a crate. That cutout simulation is of critical importance to the present invention because only a proper simulation of the lifting of a crate will yield meaningful results for use in occupational or physical therapy routines.

To simulate a cutout configuration, each handle may comprise a member having a substantially C-shaped cross-section, wherein a bottom portion of the C-shaped member receives a user's hand and transmits lifting forces to the load cells. More specifically, the handle comprises a vertical member having first end and a second end disposed below the first end. First and second horizontal members extend from the vertical member first and second ends, respectively. The vertical member second end and the second horizontal member form the bottom portion of the handle and receive the user's hands, while a top surface of the second horizontal member engages the load cell to transfer force from a user's hands through the load cell and onto the lift box frame. A top portion of the handle forms a guard for isolating lifting forces from sides of the box and the shell which covers the frame. The top portion of the handle comprises the first end of the vertical member and the first horizontal member. A bottom surface of the first horizontal handle member fits over a top edge of the frame and shell to form a guide to isolate the user's hands and arms from sides of the box and shell. An inside surface of the vertical handle member is immediately adjacent an outside periphery of the frame to position the second horizontal member within an outer periphery of the shell to facilitate the simulation of a handle cutout within a crate.

The lifting box may also include an extension member arranged and configured to attach to a bottom portion of the frame, wherein the extension member is adapted to raise the lifting box vertically with respect to a user to facilitate lifting of the box.

In another preferred embodiment of the invention, all surfaces which might potentially come in contact with the lifter's hands including the side walls of the box which contain the hand hole cutouts, as well as the bottom surface of the box which will come in contact with the users hands during the lift, are integrated into a unitary handle. In this embodiment the unitary handle is connected to load cells which are in turn connected to the portion of the frame in which the weights are added or removed as part of the testing procedure. In addition, the lift box includes a spacer on the bottom surface to raise the lifting surface off of the floor which keeps the load cells from registering load until the user begins to lift the box, and also to allow the user to conveniently get his or her fingers under the bottom edge of the box before a load is actually applied to initiate a test.

More specifically, the unitary handle member includes a bottom spacer element having an extension height for raising the frame vertically with respect to a user and for protecting a bottom portion of the shell, wherein the bottom spacer element further includes first and second ends disposed opposite one another. First and second vertical members extending upward from the first and second spacer element ends to comprise gripping portions of the handles. Additionally, the first and second vertical members include first and second cutout portions disposed therein, respectively, wherein the first and second cutout portions are arranged and configured to accept left and right hands of a user. First and second horizontal members disposed above and projecting inward from the first and second vertical members and within a periphery of the outer shell include top and bottom surfaces have bottom surfaces which are arranged and configured to accept fingers of a user's left and right hands, respectively. Top surfaces of the second horizontal members are adapted to engage the load cells on the frame for transmitting lifting force from the user's hands to the load cells.

A user performs isoinertial lifting on a lift box by grasping through hand hole cutouts. In the second embodiment, the user grasps the box at a lower portion as though lifting on a box which had no hand hole cutouts. In either case, force transmitted through the hands to the box is measured by load cells, and the electronic signal is conditioned and sent on to a processing unit or computer to display and store the data.

The electronic signals from the load cells are amplified and routed to an analog to digital converter. The digital values are sent through a serial line driver to a micro processor which then either stores the data locally on the lifting box for transmission to the host computer at a later time, or transmitted to a computer in real time so that the lifting data can be combined with real time video data taken from a video camera which has been positioned to observe the posture of the user during the lift. An analysis can then be made for determination of individual's box lifting capability or ability to perform a lift at a certain level or load.

In either embodiment, it should be recognized that the means for transmitting the data from the lift box to the computer can be "hard wired" as described above, or "wireless", such as digital infrared transmission or radio transmission.

BRIEF DESCRIPTION OF THE DRAWINGS

The accompanying drawings incorporated in and forming a part of the specification illustrate several aspects of the present invention, and together with the description serve to explain the principles of the invention. In the drawings like numerals illustrate like parts throughout the several views.

FIG. 13 is a screen of results that is entered into from the screen of FIG. 9 by selecting the results button.

Figure 1:
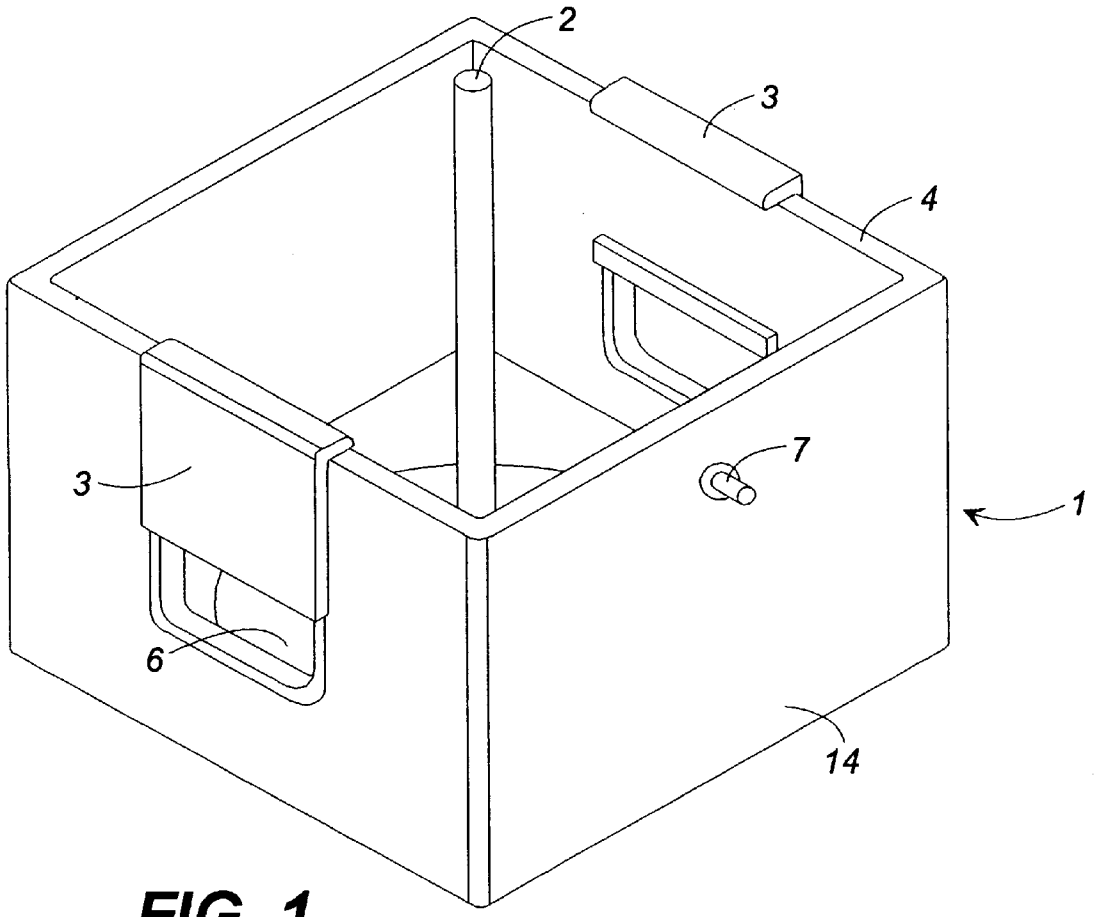
FIG. 1 is a perspective view of the assembled lift box with two separate handles with integral guards to protect the user from applying loads laterally to the sides of the box during the lift.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE ILLUSTRATED EMBODIEMENT

FIGS. 1–6 illustrate various components of an isoinertial lifting box constructed in accordance with the present invention. FIG. 1 illustrates a complete lift box generally designated by the numeral 1. Lift box 1 includes an outer shell or shell 14 having hand hole cutouts 6 which are arranged and configured to receive lifting fingers of a clinical patient. Hand hole cutouts 6 receive two individual handles 3 which are arranged and configured to complementarily engage load cells 5 within the lift box frame 4.

Figure 2:
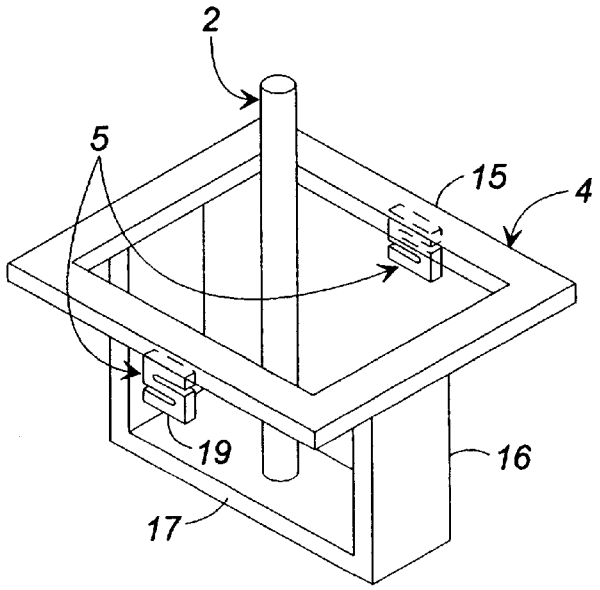
FIG. 2 is a perspective view of the assembled lift box with the handles and outer covering removed.
Figure 4:
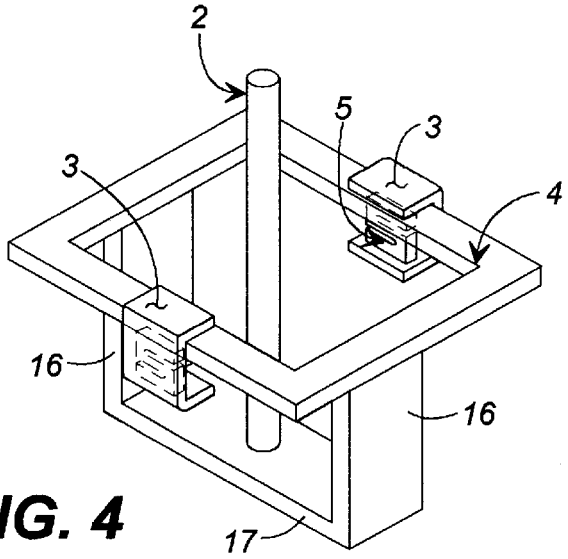
FIG. 4 is the same as FIG. 2, with the two separate handles shown installed onto the load cells.

More specifically, shell or skin 14 provides an outer cover to the lift box frame 4. Frame 4 essentially bears the load of weight secured within the box and provides a rigid foundation for load cells 5. FIGS. 2 and 4 illustrate the lift box frame with and without handles secured thereto, respectively. Starting with FIG. 2, lift box frame 4 includes a top rectangular frame component 15 which serves as a top perimeter for the box and as a securing point for the load cells 5. Vertical members 16 attach to and extend downward from rectangular component 14. Horizontal member 17 extends between vertical members 16 and supports guide pin 2, which extends vertically upward from horizontal member 17. Guide pin 2 receives standard "disc"weights (not shown). Lift box frame 4 may be comprised of nearly any material which is suitable to rigidly support disc weights and the load cells 5. Such materials may include, but are not limited to metal alloys and high-strength polymers.

Figure 3:
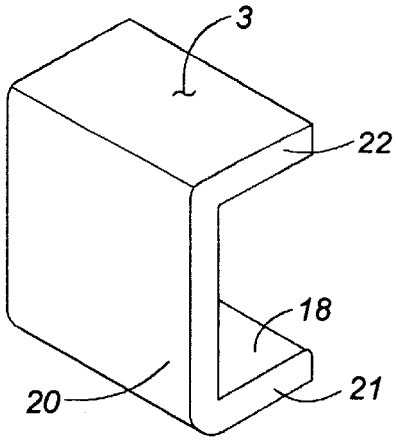
FIG. 3 a perspective view of one of the two handles used in FIG. 1.

FIGS. 3 and 4 illustrate the handles 3 which receive the gripping hands of an occupational therapy patient or user. The lift box handles 3 are arranged and configured to shield the users hands from the outer shell 14 of the lift box 1 to allow all lifting forces applied by the user to be transferred directly to the load cells 5 rather than to another other portion of the lift box, such as shell 14. More specifically, handles 3 essentially comprise a shortened C-shaped cross-section having one substantially vertical component 20 having first and second ends, and members 21 and 22 extending horizontally from the first and second ends of vertical component 20, respectively. To properly and completely transfer lifting forces to the load cells, the handles 3 should be substantially rigid as compared to the load cells 5. During a lift phase, a user's fingers contact a lower portion of the handles 3 while upper portions of handles 3 isolate the user's hands and lower forearms from sides of the shell and frame to insure a more accurate force reading from load cells 5.

Load cells 5 may comprise virtually any transducer which senses a force and which converts the force into an electrical signal proportional to the force applied thereto. Additionally, the load cells 5 may comprise multiple axis load cells which are capable of not only measuring force in the vertical direction but also in the horizontal simultaneously. Examples include, but are not limited to piezoelectric materials disposed between upper handle surface 18 and lower load cell surface 19, or a load cell having resistive module placed on deformable member, wherein the resistance of the module increases by an amount which is directly proportional to cell deformation, and consequently, force applied to the cell.

In a preferred embodiment, an upper surface 18 of horizontal member 21 rigidly receives a bottom portion 19 of load cells 5, as FIGS. 2 and 3 illustrate. Handle 3 and lift box frame 4 are preferably substantially rigid with respect to the load cells 5 so that forces are properly transmitted through the load cells 5 for further signal processing, as discussed in greater detail below. The substantially flush arrangement of the handles 3 with respect to outer shell 14 insures that the isoinertial box properly simulates the lifting scenario associated with that of a crate having hand holes therein, and also minimizes a moment created about the handles 3.

In operation, a user inserts the fingers of his or her hands through the openings 6 to lift the box 1. Here, it is important to note that the handles are substantially flush with the outer shell 14 so as to simulate the lifting of a crate which has openings incorporated into sides thereof. Indeed, one purpose of the invention is to simulate handle openings within the side of a crate or the like, rather than simulating handles which exist outside the periphery of a crate. As a user imparts an upward force onto handles 3, handles 3 transfer the entire upward force through load cells 5 and onto rigid lift box 4, which contains the disc weights aligned onto guide pin 8. As discussed in greater detail below, load cells 5 produce an electrical signal proportional to the forces transmitted therethrough. The load signal is then amplified and further processed as discussed in greater detail below.

Figure 5:
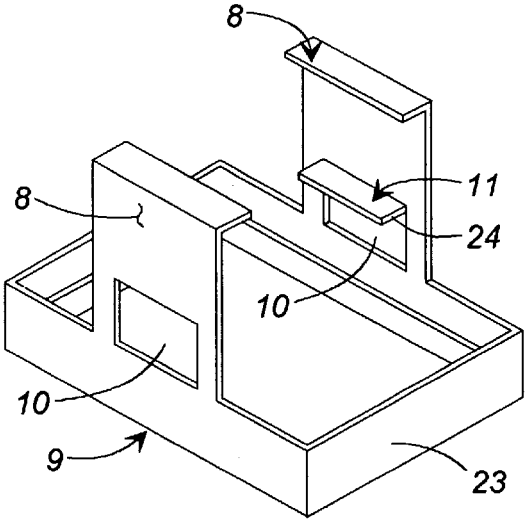
FIG. 5 is a perspective view of the one piece handle arrangement in which the hand hole cutouts and the box bottom are integrated.

FIG. 5 illustrates an alternative embodiment of the present invention. In that embodiment, lift box 9 includes a lower rectangular frame component 23 having handles 8 extending vertically upward therefrom. Handles 8 include openings 10 in a center portion thereof for accepting fingers of a user during a lift mode. Handles 8 also include tabs 11 having upper surfaces 24 which engage lower surfaces 19 of load cells 5. Thus, lift box 9 is functionally equivalent to the handles 3 which are referenced in FIGS. 1, 3 and 4, and are secured to load cells 5, which are referenced in FIGS. 2 and 4, at surface 11 in the same manner as the handles 3 illustrated in FIG. 1. As in the manner discussed above, lifting forces applied at the partial bottom of the lift box 9 are transferred through surface 11 to the load cells 5. Additionally, as illustrated in FIG. 2, the present invention may also include a spacer block 90 which is adapted to engage member 17 to raise the frame and shell upward without a force registering on the load cells. This performs several functions, with respect to the first embodiment, spacer block 90 raises the isoinertial lifting box reduce a user's bending motion, and in the second embodiment, spacer block 90 raises a bottom edge of the box without registering a force within load cells 5 so that a user may insert his or her hands beneath a lower edge of the box to lift the box from its bottom edge.

Figure 6:
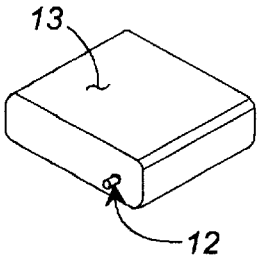
FIG. 6 is the electronic interface unit to convert the signal from the lift box to RS232 levels to interface to a computer.
Figure 7:
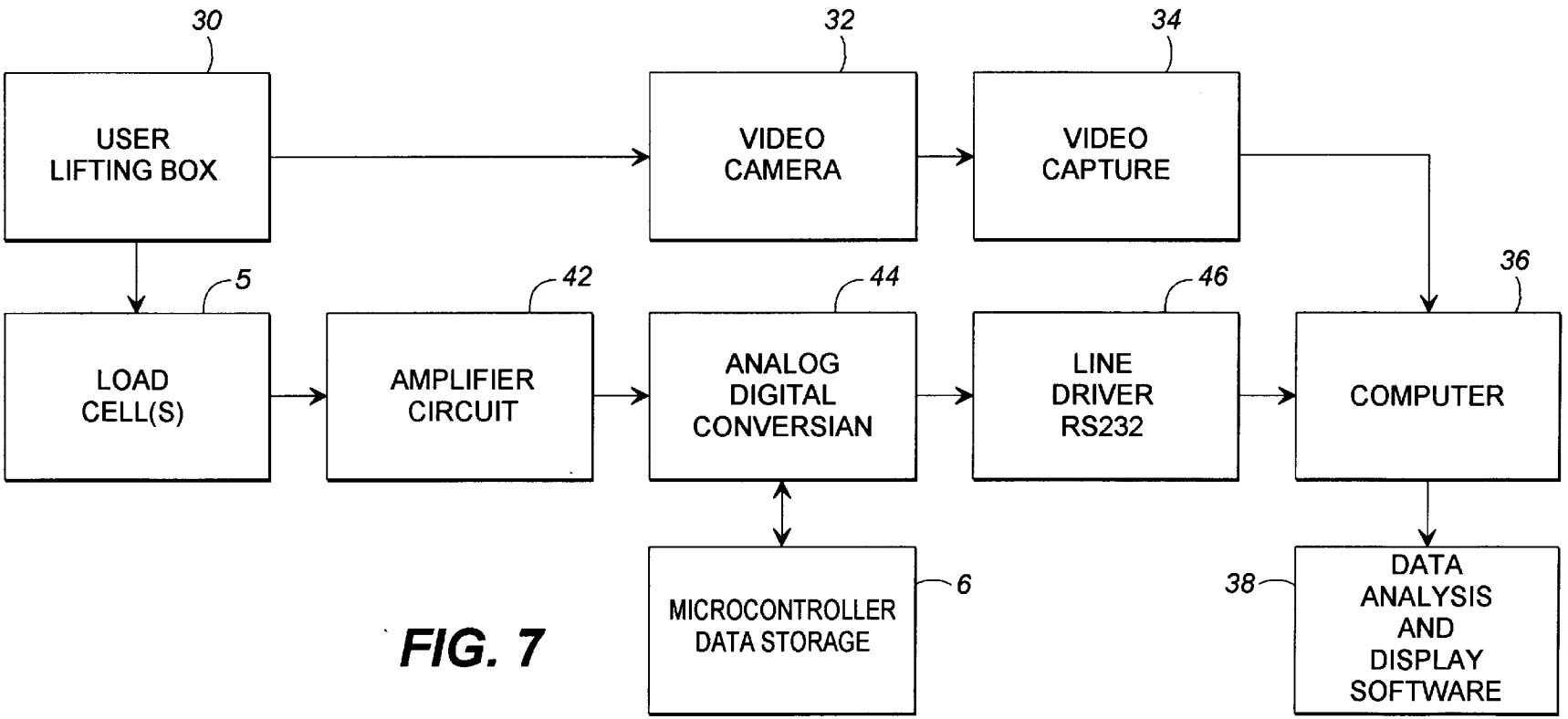
FIG. 7 is a block diagram depicting the architecture of the system and the sequence of events beginning with the force being applied to the load cells on the lift box, to the final output which is the display or printout from the software in the computer.

FIG. 7 illustrates a block diagram depicting the architecture of a control system which receives and processes data in connection with a user lifting the isoinertial lifting box, shown at module 30. More specifically, the system processes and stores data relating to the sequence of events beginning with the force being applied to the load cells on the lift box, to the final output which is the display or printout from the software in the computer. Lifting forces on the handles FIGS. 3 or 5, transmit force through and induce stress on the load cells 5. After lifting begins and force is transmitted from the user, amplifier circuit 42 causes a proportional change in its output voltage which corresponds to the input force applied to the load cells. This change in output voltage is routed from the amplifier circuit, which is then converted from an analog signal to a digital signal, as shown in module 44. Once the force has been digitized, it is stored for later retrieval, or routed to a computing device 13 for analysis or permanent storage through an electronic interface circuit 6. Additionally, FIG. 6 illustrates interface circuit 6 within hardware which connects at port 12 through a cable (not shown) to the port 7 illustrated in FIG. 1, on the lift box. Referring back to FIG. 7, line driver 46 also receives the digital signal from the analog to digital converter, which would normally be between 3 and 5 volts DC, and converts it to RS232 levels for standard serial transmission to computer 36, which includes data analysis and display software 38 for expressing the lifting force and video data in a format which allows a clinician to analyze the user's lifting techniques, muscle use and other biomechanical factors.

It is possible to integrate the entire aforementioned electrical system, as shown in FIG. 7, on the lift box 1 itself or only a part thereof. The computer 36 schematically illustrated in FIG. 7 may be situated remote from the lift box 1 and may be connected to a line driver circuit 46 or analog-to-digital converter that is situated on the lift box 1.

Software For Driving The Computer

Figure 8:
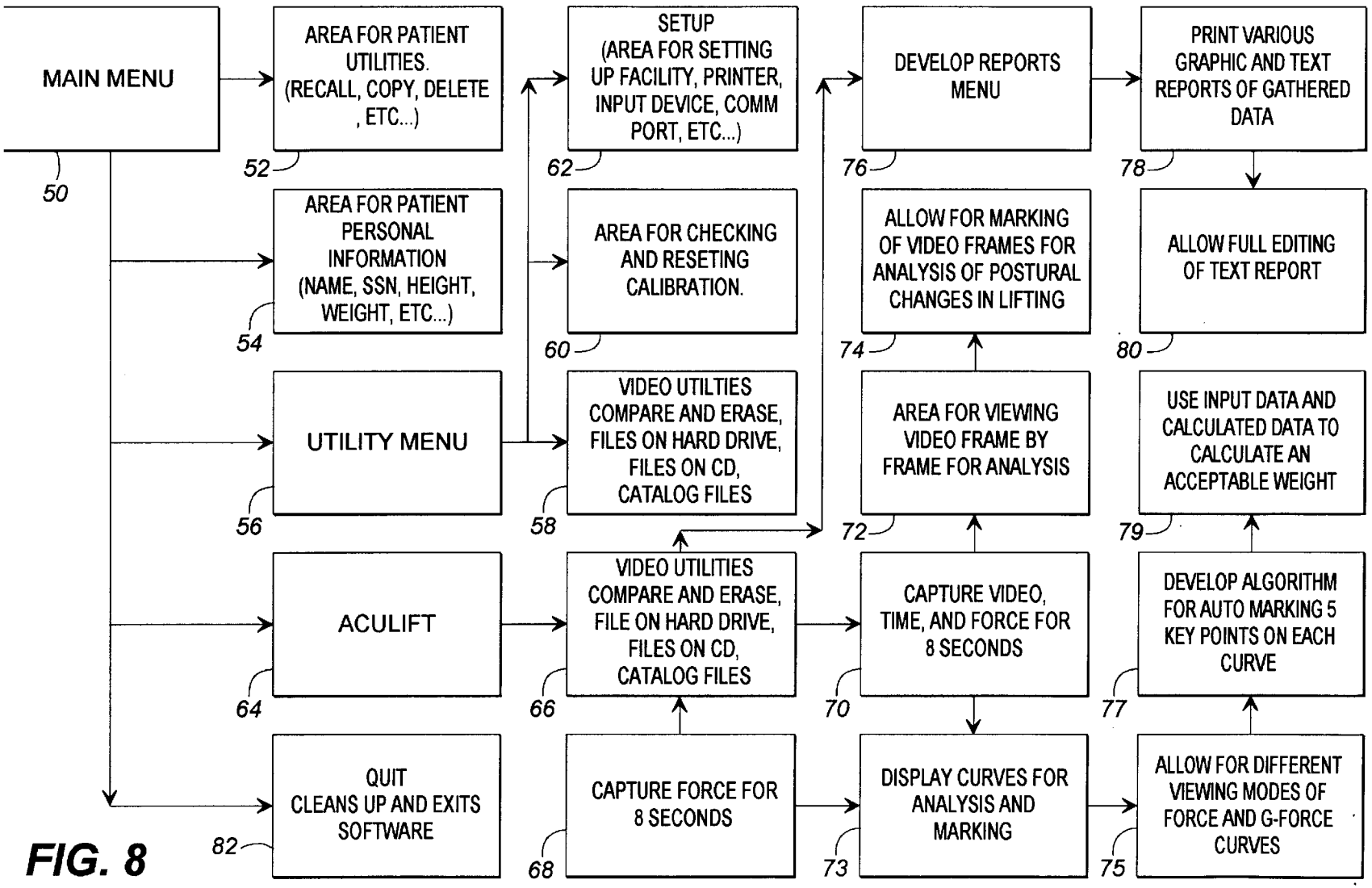
FIG. 8 is a block diagram showing the structure of menus that are associated with the software for driving the computer of FIG. 7.

The following is a description of the AcuLift module, as indicated in the block diagram of FIG. 8. FIGS. 9–12 illustrate various display screens offered by the software developed for use in conjunction with the lift box 1. FIG. 8 illustrates a functional block diagram of menu functions and choices.

The software presents five (5) menu buttons on a first menu level, as is illustrated in block 50 of FIG. 8: (1) PATIENT FILES; (2) PRE TEST DATA; (3) UTILITIES; (4) ACULIFT; and (5) QUIT (1) PATIENT FILES—The PATIENT FILES button takes the software operator to a patient utility screen, as is illustrated by block 52 in FIG. 8, which lists all patients and allows the software operator to perform functions such as recall of patient data, copy of various records to new records, and deletion patients data.

(2) PRETEST DATA—The PRETEST DATA button takes the software operator to a section where personal information about the patient (e.g., sex, height, weight, social security number, etc.) may be entered, as is illustrated by block 54 of FIG. 8. The referring physician's information may also be entered in this section.

(3) UTILITIES—The UTILITIES button, illustrated by block 56 in FIG. 8, takes the software operator to a section with 4 menu buttons: (a) SETUP; (b) VIDEO UTILITIES; ( c) CHECK CALIBRATION; (d) REBUILD DATA FILES; and (e) SETUP (a) SETUP—The SETUP button, illustrated by block 62 in FIG. 8, allows a user to a screen that allows the software operator to input the software operator facility information. It also allows the software operator to setup the printer, communication ports, and what measurement system the software operator wishes to use. Moreover, this is where the software operator chooses the type of input device the software operator is. The AcuLift software supports both a stand alone input and the System Interface™.

(b) VIDEO UTILITIES—The VIDEO UTILITIES button, illustrated by block 58 in FIG. 8, takes the software operator to a section with 5 menu buttons: (i) Video Backup; (ii) Files on CD; (iii) Files on HD; (iv) Filenames on HD; and (v) Catalog Files.

(i) Video Backup—After burning video files from hard drive to CD, the software operator may select the Video Backup button. Upon selection it compares the video files on the hard drive with those on the CD. If the files are identical, the file is removed from the hard drive.

(ii) Files on CD—The Files on CD button will take the software operator to a screen that lists all the patients who have video files on the current CD.

(iii) Files on HD—The Files on HD button will take the software operator to a screen that lists all the patients who have video files on the hard drive.

(iv) Filenames on HD—The Filenames on HD button will take the software operator to a screen that lists all the patients who have video files on the current hard drive. It also shows the actual file name for each video sequence.

(v) Catalog Files—The Catalog Files button will rebuild the video file catalog based on the patients that are presently stored on the hard drive.

(c) CHECK CALIBRATION—The CHECK CALIBRATION button, illustrated by block 60 in FIG. 8, takes the software operator to a screen that allows the software operator to test the calibration of the input devices.

(d) REBUILD DATA FILES—Although not used very often, the REBUILD DATA FILES button runs through all of the data files and rebuilds the indexes for those files.

(4) AcuLift—The AcuLift button, illustrated by block 64 in FIG. 8, takes the software operator to a screen with two menu choices, illustrated by block 66 in FIG. 8: (a) Video Test, which allows video capture while collecting the forces for 8 seconds, as illustrated by block 70 in FIG. 8; and (b) Force Curve Test, which captures forces only for 8 seconds, as is illustrated by block 68 in FIG. 8.

Figure 9:
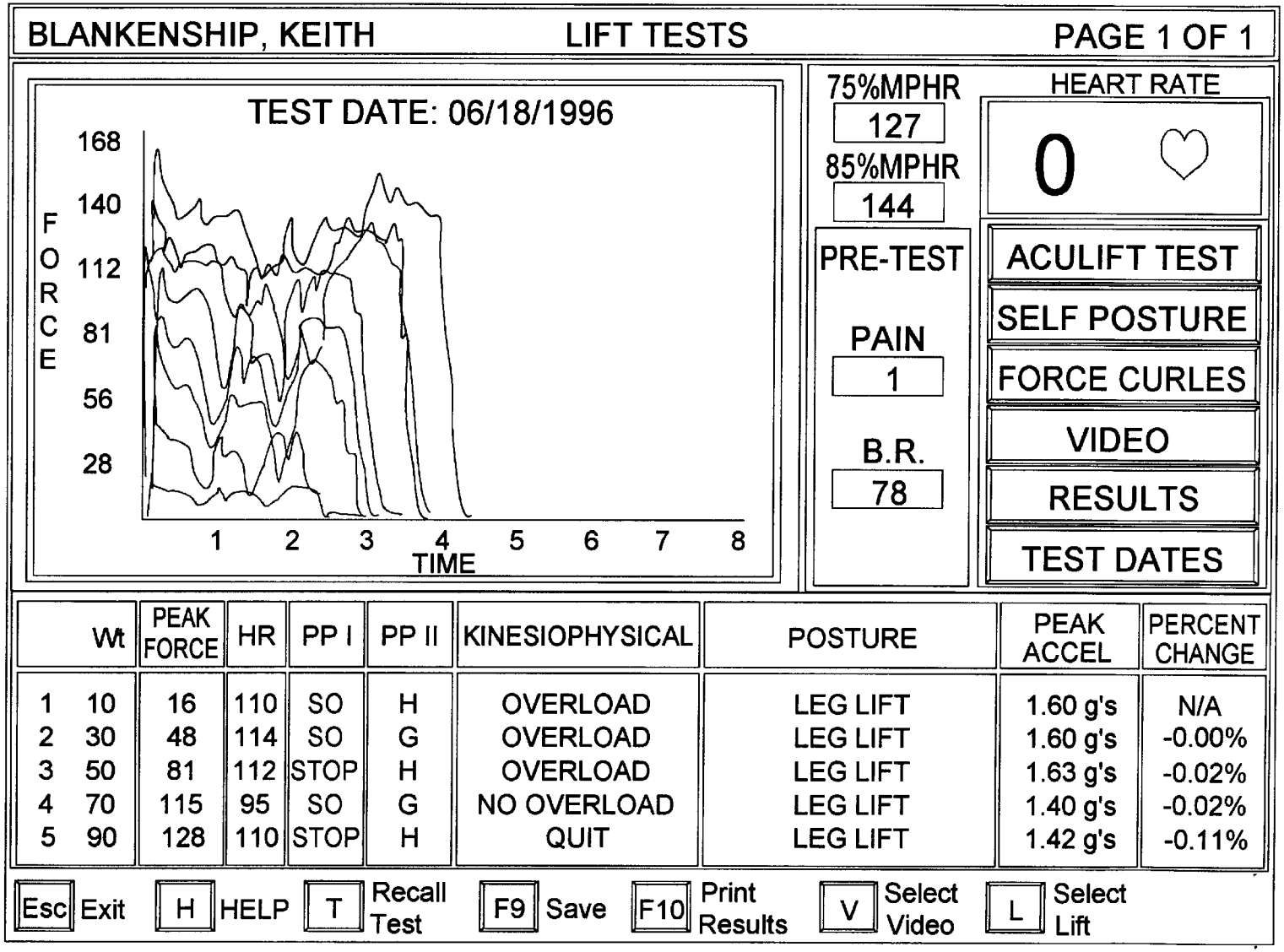
FIG. 9 is a screen showing an aculift main screen.
Figure 10:
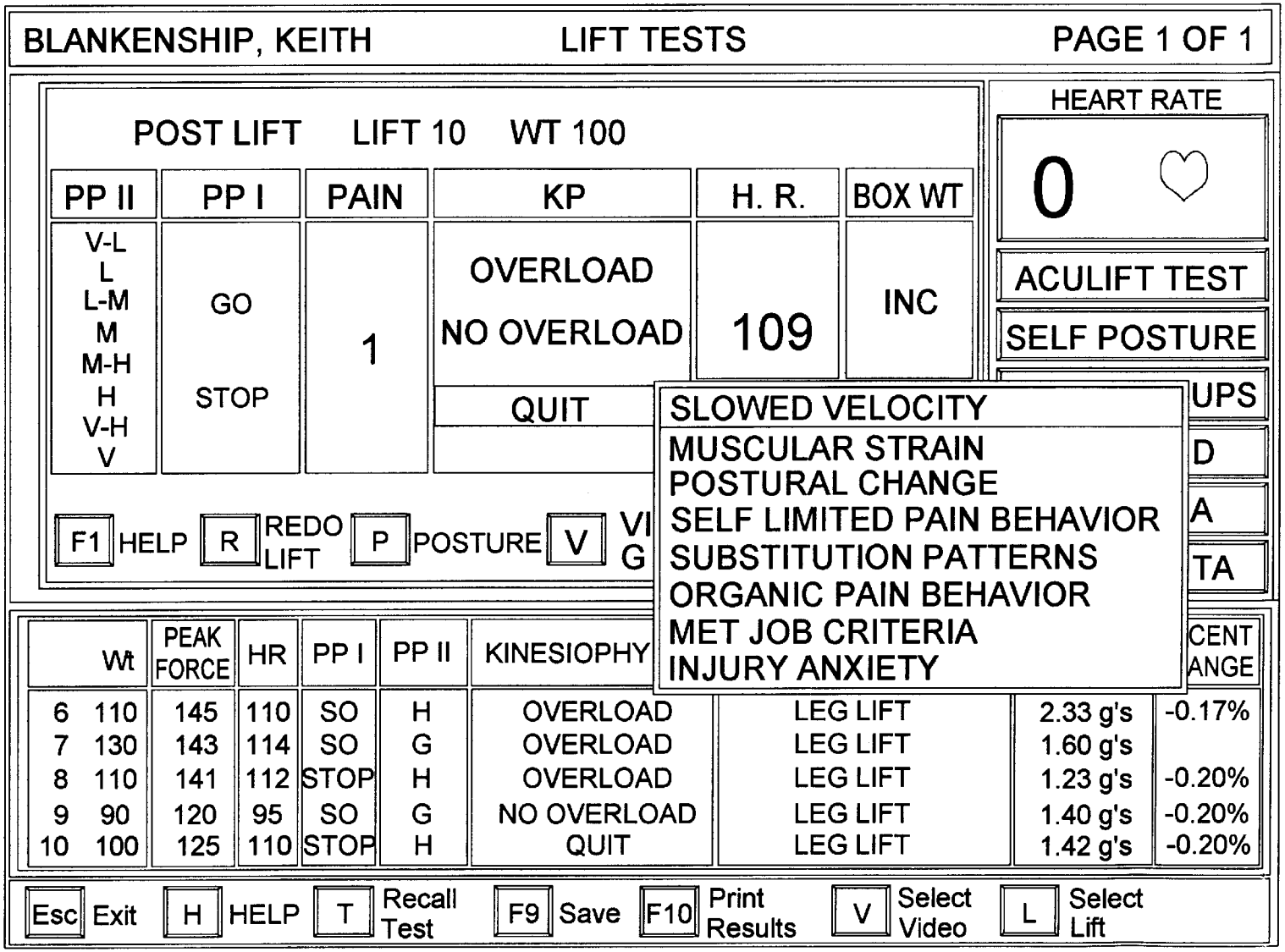
FIG. 10 is a screen that is displayed after an aculift test to prompt the user for more information.

(a) Video Test—Pressing the Video Test button takes the software operator to AcuLift's main screen, as is illustrated in FIG. 9. The main screen has a window for displaying force curves, an area at the bottom to display information about each lift, some pretest data information, and the following 6 buttons: (i) AcuLift TEST; (ii) NEW POSTURE; (iii) FORCE CURVES; (iv) VIDEO; (v) RESULTS; and (vi) EDIT DATA (i) AcuLift TEST—Upon selecting this button, a window pops up a shell for the starting weight and the weight by which the software operator wish to increment for each lift. After entering these two numbers, the software operator is taken to a new screen that displays live video on the top left quarter of the screen. The software is constantly grabbing and displaying both video and forces at this time. Once a threshold, which is adjustable, is surpassed the software begins recording both video and force. Eight seconds worth of data at 30 frames/sec is saved, as is illustrated by block 70 in FIG. 8. After saving the information to the hard drive the software returns to the main AcuLift screen. If this is the first lift in the test sequence then a window pops up a shell the software operator to enter the posture. There are four choices: Back Lift, Up Lift, Power Lift, and Custom Posture. If Custom Posture is selected the software operator is given another pop up screen with previously defined custom postures. The software operator can choose one of these or create a new one. Once this process is completed the software operator is taken to a Post Lift pop up window, as is illustrated by FIG. 10. This is where lifts 2–14 will automatically take the software operator. This window allows the software operator to input information pertaining to the lift that was just performed. Other options such as Redoing the lift and changing the weight increment are also available from this window. Unless Quit is selected the software will automatically take the software operator to the next lift for a maximum of 14 lifts per posture. If Quit is selected then a final pop up window is displayed a shell for the Psychophysical Weight and the Kinesiophysical Weight.

(ii) NEW POSTURE—Selecting this button will start a whole new testing sequence for a new posture. It will allow the software operator to save the current test the software operator is working on then it will pop up a window shell if this testing sequence will be video or non video.

Figure 11:
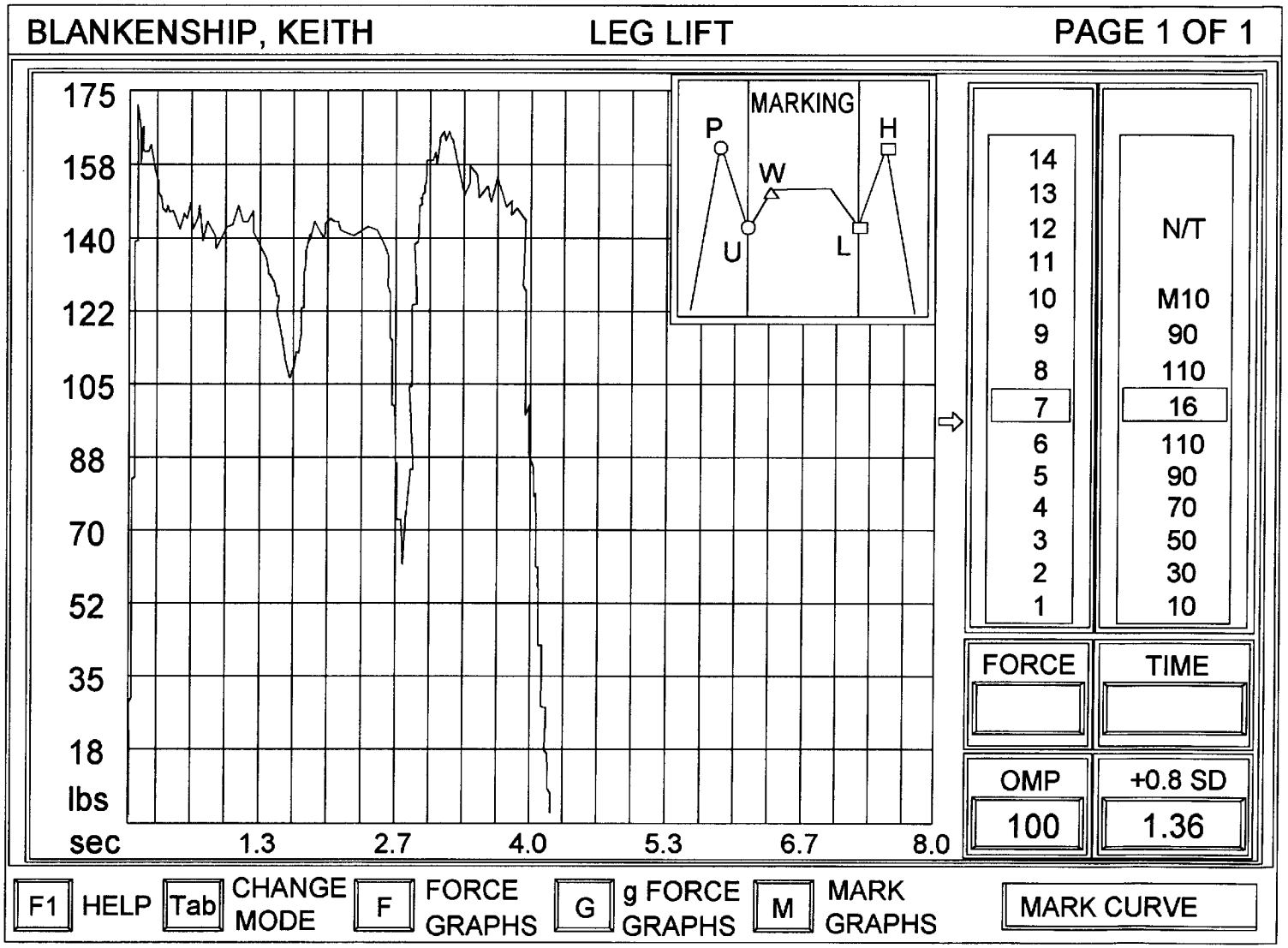
FIG. 11 is a screen of force curves that is entered into from the screen of FIG. 9 by selecting the force curves button.

(iii) FORCE CURVES—Selecting this button will take the software operator to a force curve screen, as is illustrated in FIG. 11. There are two different types of force curves that can be displayed in this screen, force curves and g-force curves, as is illustrated by blocks 73 and 75 in FIG. 8. Both have multiple display options. Force curves can be displayed in the following modes: Mark Curve; Show Marks; All Curves; and One Curve. Mark Curve allows the marking of the 5 key points on the curve, and displays both the force curve and marks. Show Marks displays marks only (both individually and all at once). All Curves displays all curves and One Curve displays the curve only with no marks.

All force curves modes are shown on force versus time scale. The following modes can be displayed for the g-force curves: g-Force Curve; Acceleration Peaks; and Deceleration Peaks. The g-Force Curve displays the force curve on a gravity scale. The Acceleration Peaks mode displays all lifting peaks, and the Deceleration Peaks mode Displays all lowering peaks. All g-force curves modes are shown on g's/time scale.

Next, the software operator may mark 5 key positions on each curve, as is illustrated by block 77 in FIG. 8. They are the peak force during the lifting portion of the lift, the lowest force during the lifting portion of the lift, the upright position, the lowest force during the lowering portion of the lift, and the peak force during the lowering portion of the lift. Next, the software system uses input data and calculated data to calculate an acceptable lifting weight for the patient, as is illustrated by block 79 in FIG. 8. There are many functions performed by different key presses in this screen. Table 1 illustrates some of the key strokes:

TABLE 1

Key Strokes

| KEYSTROKE | FUNCTION |
|---|---|
| A | Auto show first to last lift |
| C | Clear all marks on all curves |
| D, E | Erase all marks on current curve |
| F | Display Force graphs |
| G | g-Force graphs |
| H | mark peak lowering force |
| I | Auto mark current curve |
| K | Toggle marking key On/Off |
| L | Mark lowest lowering force |
| M | Auto mark all curves |
| P | Mark peak lifting force |
| R | Auto show last to first lift |
| S | Toggle Standard deviation lines On/Off |
| V | Mark lowest lifting force |
| W | Mark upright position |
| Z | Change force curve starting point |

Figure 12:
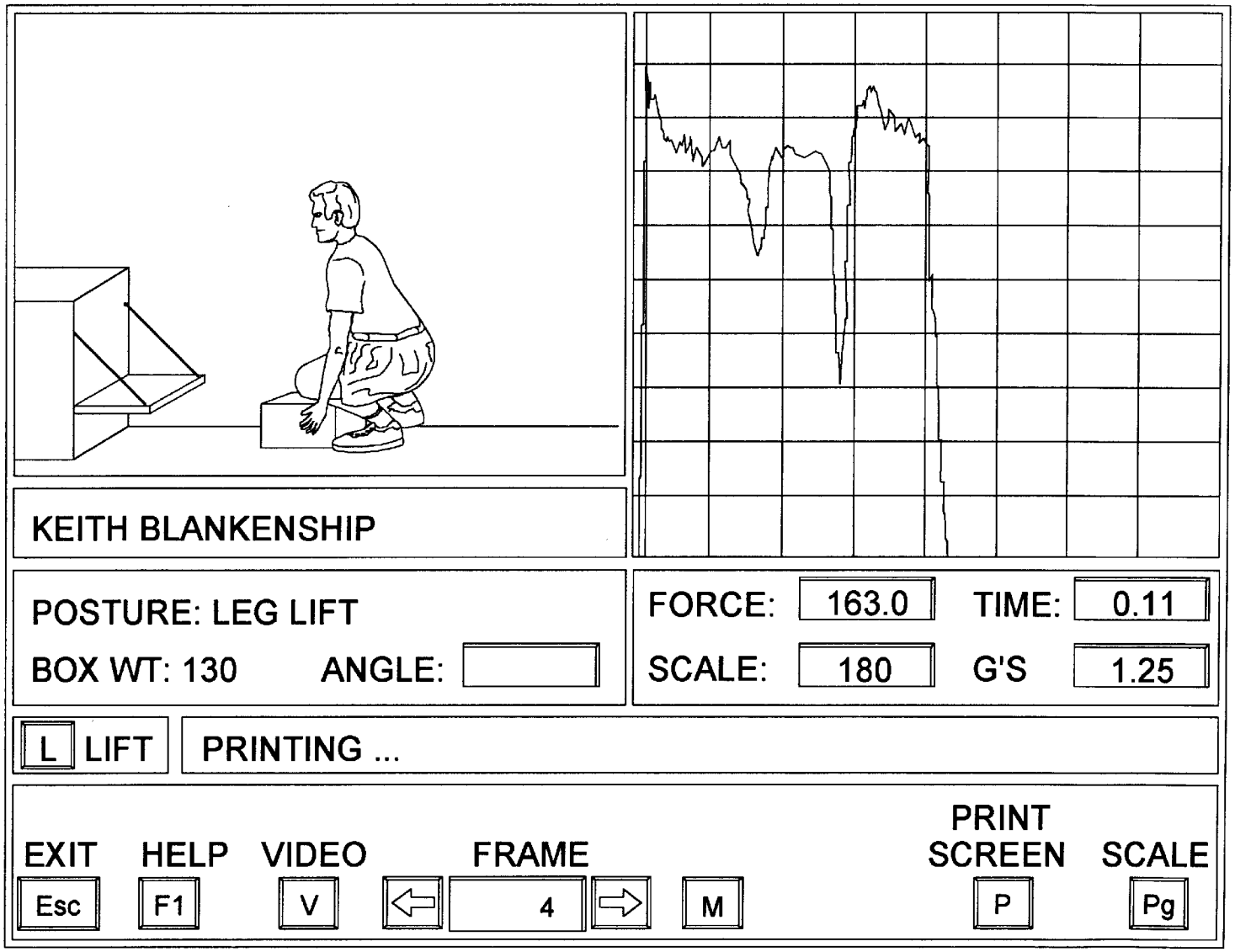
FIG. 12 is a screen of video that is entered into from the screen of FIG. 9 by selecting the video button.

(iv) VIDEO—The VIDEO button takes the software operator to a new screen in a 640×480×32K video mode. This area is used to analyze video frames in relation to points on the force curve, as is illustrated in FIG. 12. The video may be played back at real time, viewed frame by frame, and marked in different ways, as is illustrated by block 72 in FIG. 8. If the M key is pressed a video marking window pops up to the right of the video window which gives the software operator an opportunity to analyze postural changes in lifting, as is illustrated in block 74 in FIG. 8. There are six pages to this window. Each page has its own marking purpose. The marking purposes are as follows: Digitizing; Lift Marks; Reference Marks; Global Marks; and Set Origin.

Digitizing—This page is used to mark the different joints on the body. Nine marks are predefined leaving five undefined. As joints are marked the joint angles and segment angles are auto calculated and displayed.

Lift Marks—This page uses rotatable lines to mark angles on the patient. These marks are saved in reference to the video frame number for each lift and are stored with the patient. There are three predefined lines, leaving seven undefined.

Reference Marks—This page is used in conjunction with Lift Marks. The ten lines may be toggled on and off for comparison between lifts (e.g. The software operator marked the torso angle on lifts 1, 4, and 7. If the software operator turns on line one all three lines will be displayed for comparison).

Global Marks—This page has ten lines that may be marked. They are stored the same regardless of patient loaded. They are helpful in such as marking the distance of the box from the floor, so lifts may be marked at the same point in a lift.

Calibration—This page is used to convert pixels to actual distances. A known horizontal and vertical distance is marked and their respective distances are entered.

Set Origin—This page is used in conjunction with Calibration. After calibrating the software operator may set an origin point and then move a cross hair around the screen. Horizontal, Vertical, and Linear distances from the origin will be displayed. All pages use the same keys to toggle which marks to display. Patient direction facing is also set on any page. The option to display the video frame or a black background is also available.

(v) RESULTS—The RESULTS button takes the software operator to a results screen, as illustrated in FIG. 13. Based on different formulas and weighing criteria an acceptable weight for the posture is calculated. The criteria if used is highlighted in blue. The weight closest to the calculated weight is highlighted in red. This is the weight that is used for the video frames in the Results printout. The red highlight may be changed with the left and right arrow keys, so that a different weight will be printed.

(vi) EDIT DATA—The EDIT DATA button takes the software operator to change the information in the Post Lift data portion of the lift. After a lift is selected it pops up the same window that is displayed in FIG. 10.

Pressing F10 from AcuLift's main screen takes the software operator to the report screen for the purpose of developing reports, as is illustrated by block 76 in FIG. 8. For AcuLift with video there are 5 report buttons (only 3 for non video, no digitized postures or video postures). The following 5 are the report buttons which generate various reports, as is indicated in block 78 of FIG. 8: Cover Letter; Force Curves; Results—Vidco; Digitized Postures; Video Postures; and Cover Letter. The Cover Letter button generates a template that is usually sent to the referring physician. This letter can be modified in a supplied word processor called Microstar. The Force Curves button generates a graphical report that displays force curves for all lifts in a particular posture. The Results—- Video button generates a graphical report that displays certain video frames and their respective point on the corresponding force curve. It also reports the two pages of information that are seen when selecting the RESULTS button from the main screen. The Digitized Postures button generates a graphical report that displays all of the postures that were digitized. The Video Postures button generates a graphical report that displays certain video frames and their respective point on the corresponding force curve for all lifts selected.

(5) Quit—The Quit button exits the software.

The foregoing description has been presented for purposes of illustration and description. It is not intended to be exhaustive or to limit the invention to the precise forms disclosed. Obvious modifications or variations are possible in light of the above teachings. Furthermore, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. An isoinertial lifting device for measuring lifting forces transmitted through a container handle during a lifting motion, the lifting device comprising:

a structural frame adapted to support a variable number of weights;

an outer shell attached to the frame;

first and second cutouts disposed within the outer shell on opposite sides of the frame;

first and second load cells disposed on opposite sides of the frame near the first and second cutouts, respectively; and first and second handles fastened to the frame within the first and second cutouts, respectively, wherein the handles transmit all force from a lifter's hands to the first and second load cells, respectively;

wherein the handles are substantially flush with an outside periphery of the shell to simulate cutout handles on a crate.

2. The isoinertial lifting device of claim 1, wherein the frame further comprises:

a top member having the shape of a rectangular perimeter; and a bottom member having first and second ends attached to opposite sides of the top member, wherein the bottom member includes means for accepting the variable amount of weights.

3. The isoinertial lifting device of claim 1 further comprising:

a guide pin extending vertically upward from the bottom frame member, wherein said pin is adapted to accept weights.

4. The isoinertial lifting device of claim 1 wherein:

each handle is formed from a member having a C-shaped cross-section; and a bottom portion of the C-shaped member receives a user's hand and transmits lifting forces to the load cells.

5. The isoinertial lifting device of claim 4 wherein the handles further comprise:

a vertical member having first end and a second end disposed below the first end; and first and second horizontal members extending from the vertical member first and second ends, respectively;

wherein a top surface of the second horizontal member engages the load cell to transfer force from a user's hands through the load cell and onto the lift box frame.

6. The isoinertial lifting device of claim 5 wherein:

a bottom surface of the first horizontal handle member fits over a top edge of the frame and shell; and an inside surface of the vertical handle member is immediately adjacent an outside periphery of the frame to position a the second horizontal member within an outer periphery of the shell to facilitate the simulation of a handle cutout within a crate.

7. The isoinertial lifting device of claim 1 further comprising:

an extension member arranged and configured to attach to a bottom portion of the frame, wherein said extension member is adapted to raise the lifting box vertically with respect to a user to facilitate lifting of the box.

8. The isoinertial lifting device of claim 1, wherein the handles further comprise:

a bottom rectangular element adapted to enclose and protect a lower portion of the shell, the bottom element further including first and second ends disposed opposite one another, wherein the first and second ends of the bottom element are adapted to accept the hands of a user;

first and second vertical members extending upward from the first and second spacer element ends, respectively;

first and second cutout portions disposed in the first and second vertical members, wherein the first and second cutout portions are arranged and configured to accept left and right hands of a user;

first and second horizontal members disposed above and projecting inward from the first and second vertical members and within a periphery of the outer shell, the first and second horizontal members including top and bottom surfaces, wherein the bottom surfaces are arranged and configured to accept fingers of a user's left and right hands, respectively, and wherein the top surfaces are adapted to engage the load cells on the frame for transmitting lifting force from the user's hands to the load cells; and wherein the bottom element is arranged and configured to receive the user's hands on the first and second ends, respectively, to simulate the user lifting an object from its bottom edge, or alternatively to receive the user's hands within the cutouts to simulate the lifting of an object from cutout handles.

9. The isoinertial lifting device of claim 8, wherein the space element further comprises a peripheral wall for surrounding and protecting bottom corners of the shell.

10. The isoinertial lifting device of claim 1 wherein:

the handles are arranged and configured to transmit forces exclusively to the load cells.

11. The isoinertial lifting device of claim 1 wherein:

the handles are arranged and configured to isolate the user's lifting forces from the shell of the lifting device.

12. The isoinertial lifting device of claim 1 further comprising:

a mechanism coupled to the load cells for converting forces transmitted thereto into electrical signals representative of lifting force of transmitted through the handles; and means for generating and storing data comprising lifting forces as a function of time from the electrical signals created during a lift cycle.

13. The isoinertial lifting device of claim 12 wherein:

the data storing means is located on the device; and wherein the lifting device further includes an interface for transferring the data to a computer for further processing, display and storage.

14. The isoinertial lifting device of claim 12 further comprising:

means for transmitting lifting force data in real time to a microprocessor for further processing, display and storage.

15. The isoinertial lifting device of claim 14, wherein the transmitting means transmits the lifting data to the computer via wireless telemetry.

16. An isoinertial lifting system for measuring lifting forces transmitted through a container handle during a lifting motion, the system comprising:

a structural frame adapted to support a variable number of weights, wherein the frame includes an outermost periphery; and first and second handles fastened to the frame, wherein the handles transmit all force from a lifter's hands to the first and second load cells, respectively;

wherein the handles are arranged and configured to receive the user's fingers at a location which is within the outside periphery of the frame to simulate cutout handles on a crate.

17. The isoinertial lifting system of claim 16 further comprising:

an outer shell attached to the frame for defining the outermost periphery of the frame; and first and second cutouts disposed within the outer shell on opposite sides of the frame, wherein said cutouts are arranged and configured to accept the user's fingers during a lifting phase, wherein the lifting force from the user is transferred directly from the users fingers within the outer periphery to the load cells.

18. The isoinertial lifting device of claim 17 wherein:

the handles are arranged and configured to isolate the user's lifting forces from the shell of the lifting device.

19. The isoinertial lifting system of claim 16 further comprising:

a mechanism coupled to the load cells for converting forces transmitted thereto into electrical signals representative of lifting force of transmitted through the handles; and means for generating and storing data comprising lifting forces as a function of time from the electrical signals created during a lift cycle.

20. The isoinertial lifting system of claim 19 wherein:

the data storing means is located on the frame; and wherein the lifting system further includes an interface for transferring the data to a computer for further processing, display and storage.

21. The isoinertial lifting system of claim 19 further comprising:

means for transmitting lifting force data in real time to a microprocessor for further processing, display and storage.

22. The isoinertial lifting system of claim 20 further comprising:

a video capture system coupled to the computer for capturing a lift cycle on video.

23. The isoinertial lifting system of claim 22 further comprising:

means for displaying the video data.

24. The isoinertial lifting system of claim 23 further comprising:

means for displaying the video data in real time.

25. The isoinertial lifting system of claim 21, wherein the transmitting means transmits the lifting data to the computer via wireless telemetry.

26. The isoinertial lifting device of claim 1, wherein the handles further comprise:

a bottom rectangular element adapted to enclose and protect a lower portion of the shell, the bottom element further including first and second ends disposed opposite one another, wherein the first and second ends of the bottom element are adapted to accept the hands of a user;

first and second vertical members extending upward from the first and second spacer element ends, respectively, wherein the first and second vertical members are adapted to engage the load cells on the frame for transmitting lifting force from the user's hands to the load cells.

* * * * *